US010354502B2

(12) United States Patent
Song

(10) Patent No.: US 10,354,502 B2
(45) Date of Patent: Jul. 16, 2019

(54) CONTAINER DOOR ELECTRONIC SEAL SYSTEM

(71) Applicant: FOR-U TECHNICS CO., LTD., Uiwang-si, Gyeonggi-do (KR)

(72) Inventor: Suk Han Song, Uiwang-si (KR)

(73) Assignee: FOR-U TECHNICS CO., LTD., Uiwang-Si Gyeonggi-Do (KR)

( * ) Notice: Subject to any disclaimer, the term of this patent is extended or adjusted under 35 U.S.C. 154(b) by 0 days.

(21) Appl. No.: 15/777,938

(22) PCT Filed: Mar. 17, 2016

(86) PCT No.: PCT/KR2016/002707
§ 371 (c)(1),
(2) Date: May 22, 2018

(87) PCT Pub. No.: WO2017/099300
PCT Pub. Date: Jun. 15, 2017

(65) Prior Publication Data

US 2018/0350209 A1 Dec. 6, 2018

(30) Foreign Application Priority Data

Dec. 7, 2015 (KR) ..... 10-2015-0173492

(51) Int. Cl.
*G08B 13/08* (2006.01)
*G08B 5/36* (2006.01)
(Continued)

(52) U.S. Cl.
CPC ..... *G08B 13/08* (2013.01); *B65D 90/008* (2013.01); *B65D 90/22* (2013.01); *B65D 90/48* (2013.01);
(Continued)

(58) Field of Classification Search
CPC ..... G08B 13/08; G08B 5/36; B65D 90/008; B65D 90/22; B65D 90/48; E05C 1/004
(Continued)

(56) References Cited

U.S. PATENT DOCUMENTS 4,866,963 A * 9/1989 Leininger ..... E05B 47/0002 70/278.2
8,456,302 B2 * 6/2013 Stevens ..... G08B 13/02 340/506
(Continued)

FOREIGN PATENT DOCUMENTS

KR 10-2011-0135641 A 12/2011
KR 10-1275764 B1 6/2013
(Continued)

*Primary Examiner* — Steven Lim
*Assistant Examiner* — Kam Wan Ma
(74) *Attorney, Agent, or Firm* — Rabin & Berdo, P.C.

(57) ABSTRACT

A container door electronic seal system for sensing abnormal opening/closing of a container door comprising a retainer, on which a locking rod installed outside the container door is seated, and a handle hatch, which binds or unbinds a handle seated on the retainer, according to the present disclosure, comprises: an electronic seal, which binds the retainer and the handle hatch, and which wirelessly transmits the abnormal opening/closing information of the container door to the outside; a first connector electrically extending from the electronic seal; a second connector, which is installed on the container door, and which is electrically connected to the first connector; and a first sensing unit electrically connected to the second connector to sense whether the handle hatch is opened/closed. According to the present disclosure, a sensing unit, which senses abnormal opening/closing of the container door, is installed on the container door and is recycled, thereby making it
(Continued)

possible to implement an electronic seal system that can sense abnormal opening/closing of the container door with little costs.

4 Claims, 9 Drawing Sheets

(51) Int. Cl.

| | |
|---|---|
| ***G08B 25/10*** | (2006.01) |
| ***B65D 90/00*** | (2006.01) |
| ***B65D 90/22*** | (2006.01) |
| ***B65D 90/48*** | (2006.01) |
| ***E05B 39/02*** | (2006.01) |
| ***E05B 39/04*** | (2006.01) |
| ***E05B 83/10*** | (2014.01) |
| *E05C 1/00* | (2006.01) |

(52) U.S. Cl.
CPC ..... *E05B 39/02* (2013.01); *E05B 39/04* (2013.01); *E05B 83/10* (2013.01); *G08B 5/36* (2013.01); *G08B 25/10* (2013.01); *B65D 2590/0083* (2013.01); *E05C 1/004* (2013.01)

(58) Field of Classification Search
USPC ..... 340/545.6
See application file for complete search history.

(56) References Cited

U.S. PATENT DOCUMENTS 8,593,280 B2 * 11/2013 Tan ..... G09F 3/0317 340/541
8,773,262 B2 * 7/2014 Bae ..... E05B 39/00 340/540
9,111,467 B2 * 8/2015 Paavilainen ..... G09F 3/03
9,683,394 B1 * 6/2017 Rickrode ..... E05B 83/02
9,818,273 B2 * 11/2017 Nekoogar ..... G08B 13/06
2002/0178767 A1 12/2002 Lemley et al.
2005/0179546 A1 * 8/2005 Lanigan ..... G07C 9/00166 340/545.6
2005/0231365 A1 * 10/2005 Tester ..... G06K 19/07798 340/568.1
2006/0117820 A1 * 6/2006 Lanigan ..... B62D 33/0222 70/279.1
2008/0218353 A1 * 9/2008 Fellows ..... E05B 45/06 340/572.6
2008/0278318 A1 * 11/2008 Auerbach ..... B65D 79/02 340/539.26
2008/0309487 A1 * 12/2008 Chao ..... G08B 13/06 340/542
2009/0102653 A1 * 4/2009 McGinnis ..... E05B 45/06 340/551
2010/0194579 A1 * 8/2010 Choi ..... B65D 90/00 340/686.6
2012/0112902 A1 * 5/2012 Meyers ..... G08B 13/1436 340/539.1
2013/0033381 A1 * 2/2013 Breed ..... G08B 13/22 340/568.1
2016/0215533 A1 7/2016 Choi et al.

FOREIGN PATENT DOCUMENTS

KR 10-1484133 B1 1/2015
KR 10-1537076 B1 7/2015

* cited by examiner ( a )

( b )

CONTAINER DOOR ELECTRONIC SEAL SYSTEM

BACKGROUND

Technical Field

The present disclosure relates to an electronic seal system, and more particularly, to an electronic seal system for container door.

Background Art

Generally, a container is a box-type loading case provided to carry a cargo efficiently and economically. The container is made of woods, plywoods, steel, aluminum, light alloy, fiber reinforced plastics (FRP), and so on, and classified for general use, liquid use, automobile use, refrigeration use, heat insulation use, and so on, depending on the type of the transported cargo.

The container provides advantages including: reduced time and cost because general merchandise and special cargo can be carried with ease without requiring outer packaging; prevention of accident such as damages to cargo, loss or theft that can occur during transportation; and reduced working hours because of ease of loading cargo onto freight cars, automobiles, ships, and so on. In particular, a container mounted on a car to transport a cargo is installed with a door installed on a rear surface of the container and pivoted on a hinge, and a lock configured to control opening and closing of the door.

As illustrated in FIG. 1, a related container door includes a plurality of locking rods 11 provided at a lateral spacing from one another, along a vertical direction on an outer side of a pair of doors 10, in which upper sides and lower sides of the locking rods 11 are fixedly inserted into fixing parts 12 coupled to upper and lower frames of the container.

A handle 13 is formed on a lower end of the locking rod 11 to rotate the locking rod 11 in a lateral direction, and the handle 13 is seated on an upper side of a retainer 14 coupled to the door 10. On the upper side of the retainer 14, there is a handle hatch 15 rotatably coupled to the door 10.

Accordingly, as illustrated in FIG. 2, the retainer 14 and the handle hatch 15 are respectively provided with binding holes 14*a*, 15*a* opposing each other, in which the binding holes 14*a*, 15*a* are bound with a wire or a lock so that the handle 13 is restrained from rotating, thus preventing opening of the door 10 by an unauthorized person.

In order to open the door 10, a user upwardly rotates open the handle hatch 15 in an arrowed direction, and then rotates the handle 13 seated on the retainer 14 in a forward direction as indicated by an arrow so that the locking rods 11 are lowered by their own weight, thus withdrawn from the fixing parts 12 from the upper position and released.

However, in a related art, while it is not easily allowed to unlock the securely locked retainer 14 and the handle hatch 15, there is a possibility of breaking the brackets that hold the fixing parts 12 and the locking rods 11 of the upper and lower sides onto the door 10 to forcibly open the door 10.

In recent years, an electronic sealing system has been introduced, which provides function of not only sealing the container, but also finding position of the container through the GPS and transmitting information about whether the container is opened or closed through a mobile communication network.

The 'electronic seal' herein refers to an active electronic identification (RFID) device that senses abnormal opening or closing of the door of the electronic key device or senses abnormal attempts to open or close the door to notify the sensed result to the nearby readers and maintain the sensed result in its history.

The international standardization for the electronic seal device for cargo container management is in the process by ISO TC104 SC4 WG2, with standard document number ISO 18185.

However, the conventional electronic seal does not provide a function of sensing the forced opening of the door 10 by breaking the upper and lower fixing parts 12 and the bracket fixing the locking rod 11 to the door 10.

SUMMARY

Technical Problem

Accordingly, a technical objective of the present disclosure is to provide an electronic seal system for a container door, which is provided with an inner lock capable of preventing a forced opening of the container door by an unauthorized person, with an improvement that allows the inner lock to be locked and unlocked from inside of the container.

Technical Solution

In order to accomplish the technical objectives mentioned above, in an embodiment of the present disclosure, an electronic seal system for a container door for sensing abnormal opening/closing of a container door is provided, in which the container door includes a retainer on which a locking rod installed outside the container door is seated and a handle hatch which binds or unbinds a handle seated on the retainer. The electronic seal system may include an electronic seal, which binds the retainer and the handle hatch, and which wirelessly transmits the abnormal opening/closing information of the container door to the outside; a first connector electrically extending from the electronic seal; a second connector, which is installed on the container door, and which is electrically connected to the first connector, and a first sensing unit electrically connected to the second connector to sense whether the handle hatch is opened/closed.

The container door may further include a rotation shaft passed through the container door and extended to an inner side and an outer side of the container door, a plate coupled to the rotation shaft extended to the inner side; a lifting member rotatably coupled to the plate, and a locking bar coupled to a lower side of the lifting member to lock or unlock the container door by being fixed to, or separated from a descending portion formed on a lower portion in a container.

The first sensing unit may include a magnet installed on the plate or the lifting member, and a magnet switch configured to be turned on or off by the magnet installed on the plate to generate a signal corresponding to opening or closing of the handle hatch when the handle hatch is in the handle unlock position.

The electronic seal system may further include a second sensing unit including a wiring installed on the locking bar that breaks together when the locking bar is broken.

The electronic seal may include a RFID chip configured to sense, after electronic sealing is made, whether the handle hatch is opened or closed, whether the locking bar is broken or not, whether the electronic seal is released or not, and connection state of the first connector and the second connector, and transmit, over the antenna, the sensed result according to an external request.

The electronic seal may further include a light emitting unit configured to generate an alarm after electronic sealing is made, in which the alarm corresponds to at least one of whether the handle hatch is opened or closed, whether the locking bar is broken or not, whether the electronic seal is released or not, and the connection state of the first connector and the second connector.

Advantageous Effects

According to the present disclosure, a sensing unit, which senses abnormal opening/closing of the container door, is installed on the container door and is recycled, thereby making it possible to implement an electronic seal system that can sense abnormal opening/closing of the container door with little costs.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

BEST MODE

Hereinbelow, preferred exemplary embodiments of the present disclosure will be described in detail with reference to the accompanying drawings.

First, a container door to be provided with an electronic seal system according to the present disclosure will be described with reference to FIGS. 3 to 6.

Figure 1:
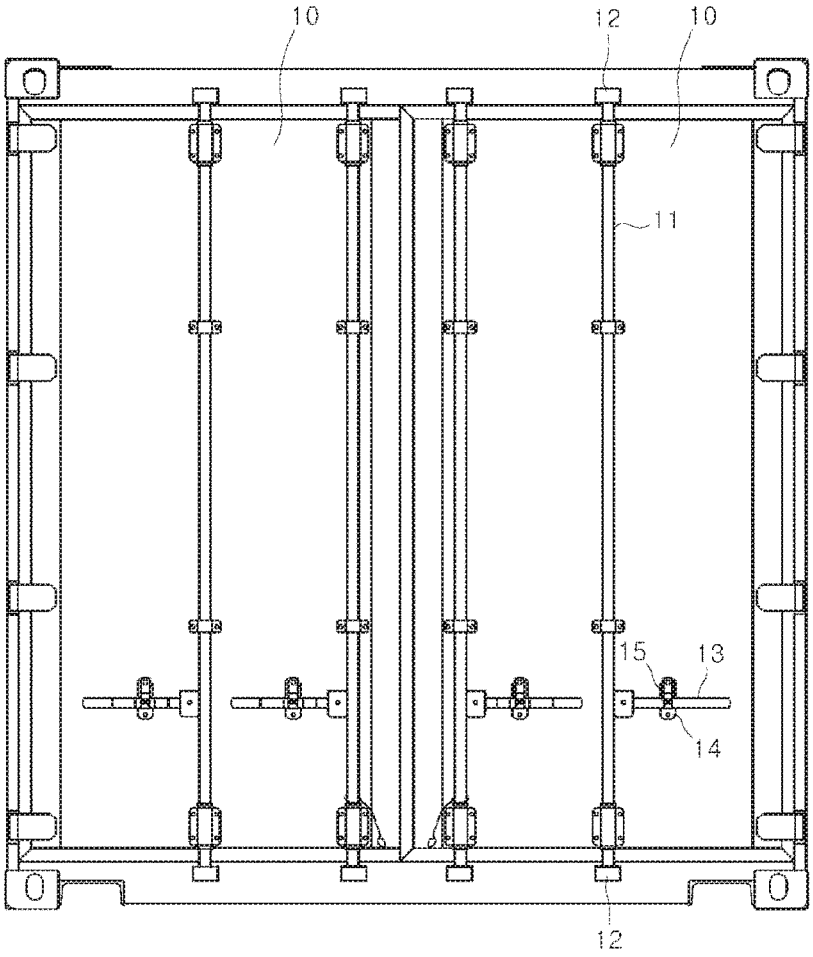
FIG. 1 PRIOR ART
FIG. 1 is a front view showing a conventional lock for a container door.
Figure 2:
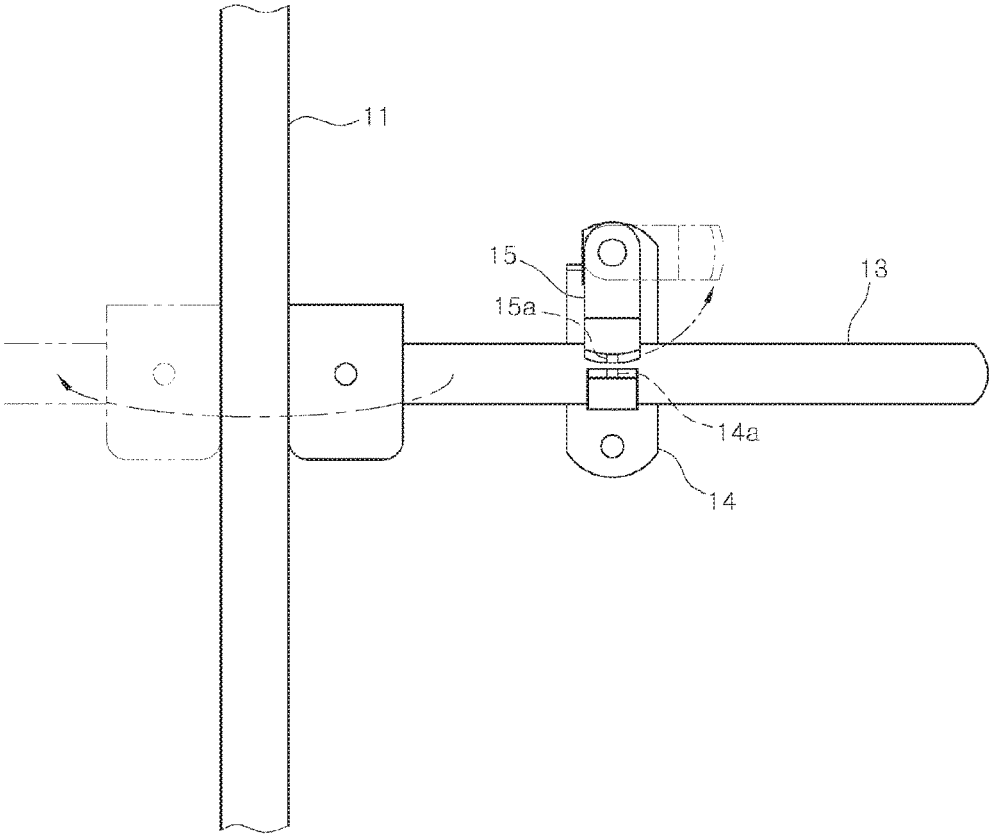
FIG. 2 PRIOR ART
FIG. 2 is a partially enlarged view showing a conventional lock for a container door.
Figure 3:
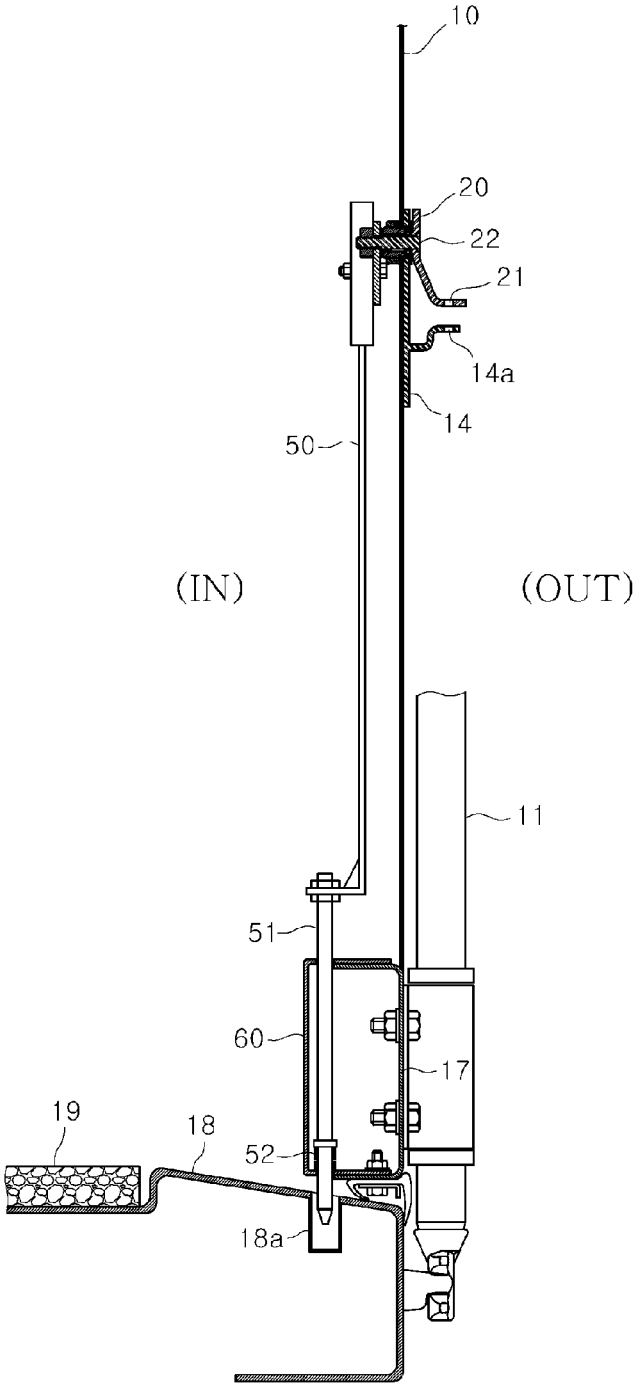
FIG. 3 is a right-side cross-sectional view showing an inner lock for a container door according to the present disclosure.

The container door to be provided with the electronic seal system according to the present disclosure may include an inner lock. As illustrated in FIG. 3, an inner lock for a container door is installed on an inner side of the container, and a handle hatch 20 is coupled with an outer side of the door 10 to open or close the inner lock by a rotation.

Figure 4:
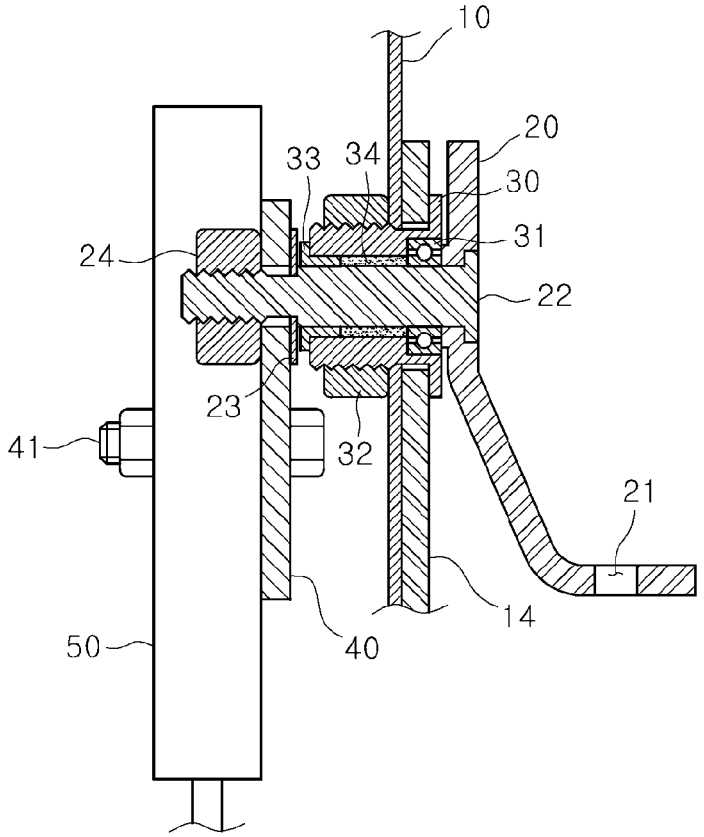
FIG. 4 is a partially enlarged view of an inner lock according to the present disclosure.

As illustrated in FIG. 4, a binding hole 21 is formed on a lower side of the handle hatch 20, and a rotation shaft 22 extending to an outer side of the door 10 is coupled with a center of the handle hatch 20.

The rotation shaft 22 is passed through the retainer 14 coupled with the outer side of the door 10 and extended to an inner side of the door 10, and a housing 30 is coupled with an outer circumference of the rotation shaft 22, passed through the retainer 14 and the door 10, and fixed at the door 10 by a housing nut 32.

A bearing 31 is coupled with one side of the housing 30 to allow smooth rotation of the rotation shaft 22, and a bushing 33 is coupled with the other side.

Accordingly, a sealed space 34 is formed in the inner space of the housing 30, between the bearing 31 and the bushing 33, and the sealed space 34 may be filled with oil such as grease to block moisture ingress into the container through the space generated when the electronic seal system when the present disclosure is installed in the door 10.

Further, a plate 40 is coupled with a leading end of the rotation shaft 22 coupled with the housing 30, and the plate 40 is fixed between a snap ring 23 and a shaft nut 24 coupled with the rotation shaft 22 so as to be rotated together according to a rotation of the handle hatch 20.

Figure 5:
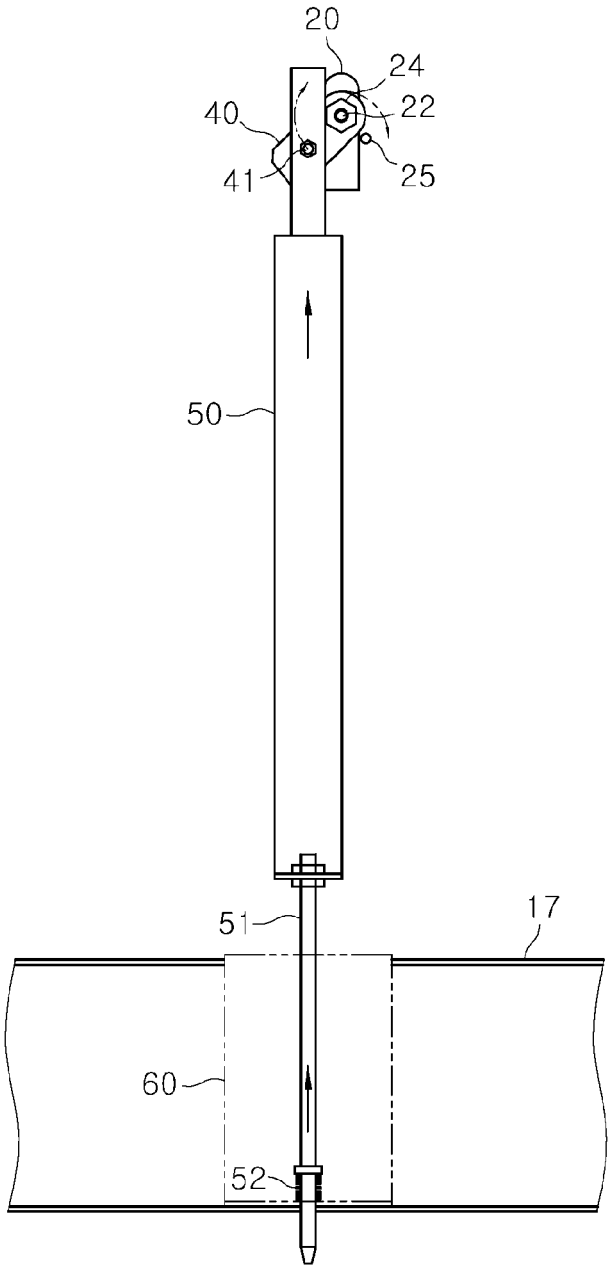
FIG. 5 is a rear view of an inner lock according to the present disclosure.

As illustrated in FIG. 5, the plate 40 is configured such that, when the door 10 is kept in the locked state, the plate 40 is kept tilted downward by 45° from the rotation shaft 22, and a shaft bolt 41 is coupled to a center of the plate 40. The shaft bolt 41 is passed through an upper end of the lifting member 50 and coupled rotatably by a nut.

The nut is loosely engaged with the shaft bolt 41 so that the lifting member 50 is rotated by the loads in accordance with the rotation of the plate 40 to be constantly kept in a vertical state.

A lower side of the lifting member 50 is formed into an approximately ‘ ’ shape and is coupled vertically with the locking bar 51 by the nut. The leading end of the locking bar 51 is passed through the cover 60 coupled to the door frame 17 and projected to the lower side of the cover 60.

The spring 52 installed on the outer circumference of the locking bar 51 constantly urges the locking bar 51 with an upward elastic force and the lower frame 18, on which a wooden bottom plate 19 is installed, has a descending portion 18*a* into which the leading end of the locking bar 51 is inserted.

With the inner lock for a container door configured as described above according to exemplary embodiments, when the door 10 is in a locked state, the handle hatch 20 is in the vertical state, and the locking bar 51 is kept in the descent state, as illustrated in FIGS. 3 and 5.

Accordingly, due to the locking bar 51 held inserted in the descending portion 18*a*, it is not possible to forcibly open the door 10 from outside. Further, since the locking bar 51 is sealing a hole formed in the lower frame 18 to be inserted into the descending portion 18*a*, moisture ingress into the container can be blocked.

Further, the binding hole 21 of the handle hatch 20 and the binding hole 14*a* of the retainer 14 positioned on the upper and lower sides opposing each other are bound by a wire and a lock, an unauthorized person’s unauthorized attempt to rotate the handle hatch 20 and unlock the lock can be prevented.

In order to open the door 10, the user rotates the handle hatch 20 in an arrowed direction (i.e., a clockwise direction) by 90° as illustrated in FIG. 5. It is preferable that a stopper projection 25 be formed at the door 10 to prevent excessive rotation of the handle hatch 20.

Figure 6:
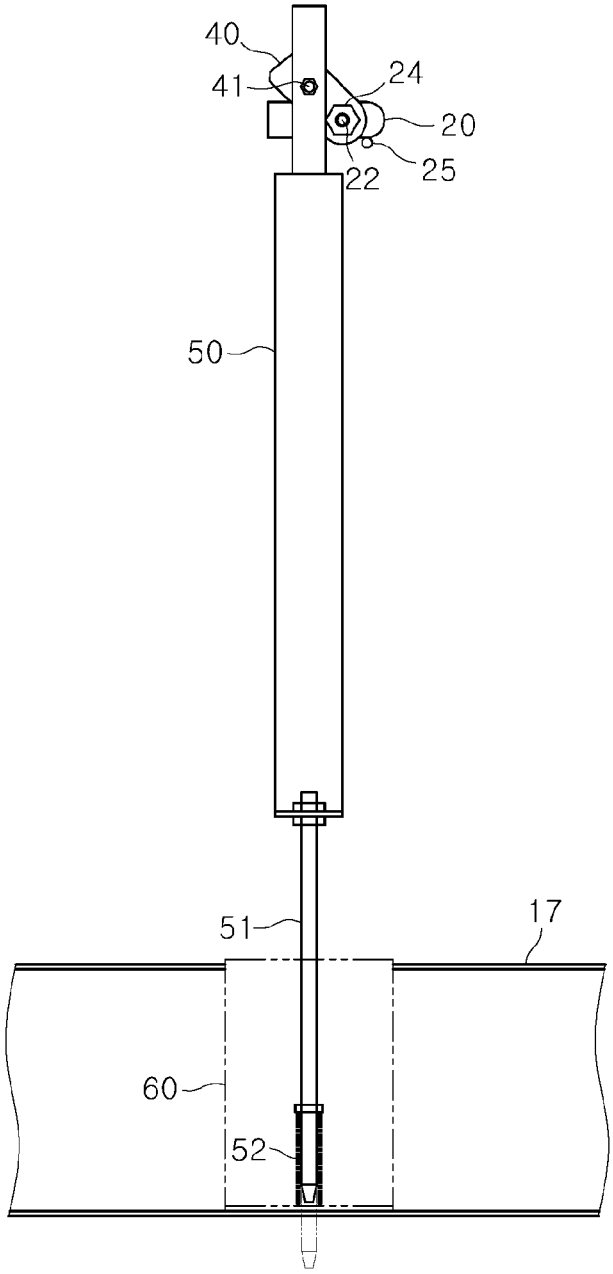
FIG. 6 is a rear view showing a state in which the inner lock of the present disclosure is open.

Meanwhile, rotating the handle hatch 20 causes the plate 40 coupled with the rotation shaft 22 to be rotated about the rotation shaft 22 upwardly by 90°, and accordingly, the lifting member 50 and the locking bar 51 ascend to the unlocked state as illustrated in FIG. 6.

Accordingly, the ascending locking bar 51 is withdrawn out of the descending portion 18*a* and the door 10 is free to open. The ascending movement of the locking bar 51 is further facilitated by the elastic force of the spring 52.

Further, since the spring 52 constantly urges the locking bar 51 in an upward direction with the elastic force, when the door 10 is open, the plate 40 and the handle hatch 20 are rotated by the loads of the lifting member 50 and the locking bar 51, thus preventing the door 10 from being locked by itself.

In order to lock the door 10, the handle hatch 20 is rotated in a counterclockwise direction by 90° to a vertical state, according to which the plate 40 is rotated downward, causing the lifting member 50 and the locking bar 51 to descend.

Accordingly, the exemplary embodiments of the present disclosure provide an inner lock configured to lock and unlock the door 10 from inside the container in accordance with the ascending and descending movement of the locking bar 51, thus providing an effect that the inner lock does not allow opening of the door 10 even when an unauthorized person breaks the fixing parts of the locking rod 11 and attempts to force open the door 10.

Further, because the door 10 is open and closed by a simple configuration and operation using a rotation of the handle hatch 20 and an elastic force of the spring 52, cost of fabrication and installation is reduced. In addition, an economic effect further increases since there is no possibility of fault.

The electronic seal system according to the present disclosure will now be described with reference to FIG. 7.

Figure 7:
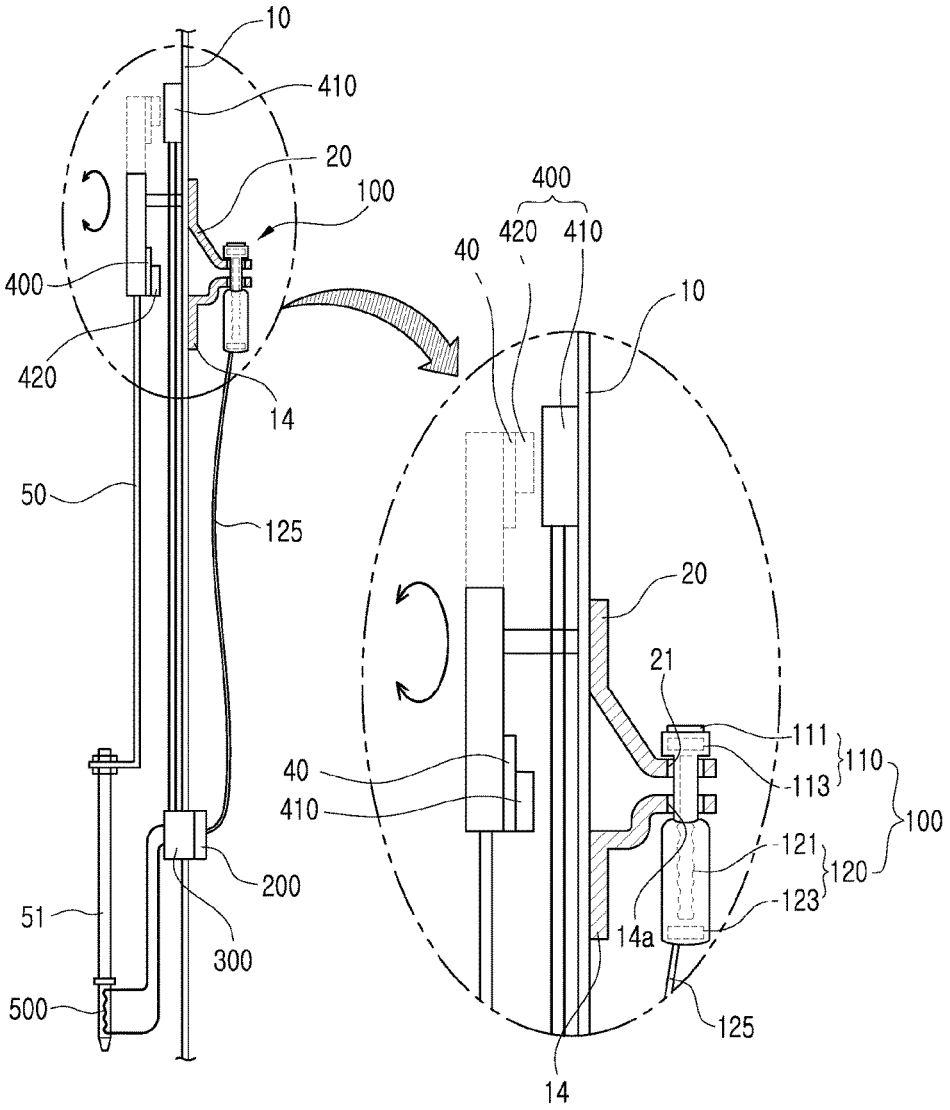
FIG. 7 is a conceptual diagram provided for explaining an electronic seal system according to the present disclosure.

FIG. 7 is a conceptual diagram provided for explaining an electronic seal system according to the present disclosure.

Referring to FIG. 7, the electronic seal system according to the present disclosure may include an electronic seal 100, a first connector 200, a second connector 300, a first sensing unit 400, and a second sensing unit 500.

The electronic seal 100 may include a light emitting unit 111, an RFID chip 113, an antenna 121, and a battery 123.

The electronic seal 100 may be divided into a head portion 110 on which the light emitting unit 111 and the RFID chip 113 are mounted, and a body portion 120 on which the antenna 121 and the battery 123 are mounted. The head portion 110 and the body portion 120 are engaged with each other through the binding hole 21 of the handle hatch 20 and the binding hole 14*a* of the retainer 14 so that the retainer 14 and the handle hatch 20 can be bound and sealed. In addition, the electronic seal 100 performs a function of wirelessly transmitting the abnormal opening/closing information of the container door to the outside, while binding and sealing the retainer 14 and the handle hatch 20 together.

The light emitting unit 111 may be implemented as an LED chip that, after electronic sealing is made, selectively emits a predetermined color (e.g., red, yellow, blue, or green). according to whether the handle hatch 20 is open or closed, whether the locking bar 51 is broken or not, whether the electronic seal 100 is released or not, or the connection state of the first connector 200 and the second connector 300.

The RFID chip 113 senses whether the container door is abnormally opened or closed, based on whether the handle hatch 20 is open or closed, whether the locking bar 51 is broken or not, whether the electronic seal 100 is released or not, or the connection state of the first connector 200 and the second connector 300, and so on, and wirelessly transmits the abnormal opening/closing information of the container door via the antenna 121 according to a request from an external reader (not shown).

The RFID chip 113 may transmit information on whether the container door is abnormally opened or closed to an external reader via the antenna 121 together with a unique ID (UID) for identifying the container sealed by the electronic seal 100.

The RFID chip 113 may determine that the electronic seal is released when the head portion 110 and the body portion 120 are separated or when the body portion 120 is broken, thus causing the antenna 121 to be broken.

The RFID chip 113 sensing whether the handle hatch 20 is open or closed, whether the locking bar 51 is broken or not, and the connection state of the first connector 20 and the second connector 30 will be described in detail below.

The antenna 121 is electrically connected to the RFID chip 113 and transmits/receives a radio signal to/from the outside.

The battery 123 supplies operating power to the electronic seal 100. The battery 123 supplies power to the second connector 300 through the first connector 200 connected by cable 125. The power supplied to the second connector 200 may allow the first sensing unit 400 and the second sensing unit 500 to sense abnormal opening or closing of the container door.

One end of the first connector 200 may be formed on the other end of the cable 125 extended from the electronic seal 100 to electrically connect the second connector 300 and the electronic seal 100.

The second connector 300 is installed on the container door and may be electrically connected to the electronic seal 100 through the first connector 200.

The first sensing unit 400 is electrically connected to the second connector 300 and senses opening or closing of the handle hatch 20. To this end, the first sensing unit 400 may include a magnet 420 and a magnet switch 410.

Figure 8:
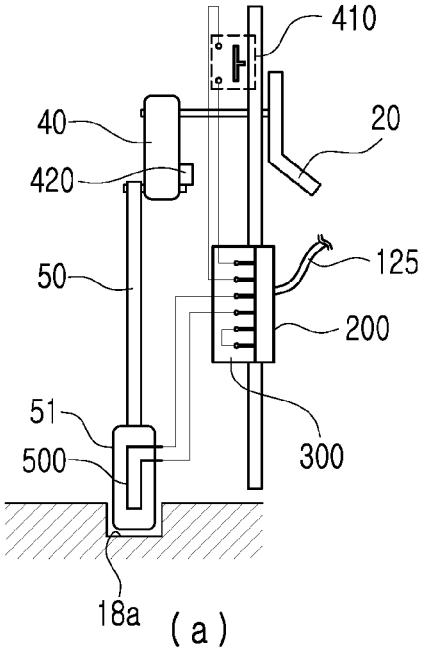
FIG. 8 is a conceptual diagram provided for explaining a connector connection of an electronic seal system according to the present disclosure.
Figure 8:
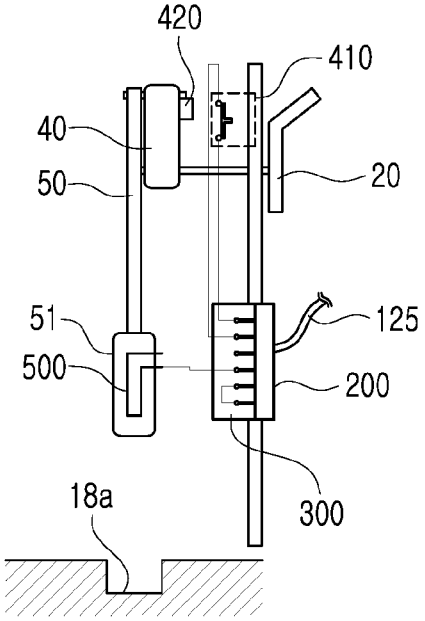

As illustrated in FIG. 8, the magnet 420 may be mounted on the plate 40. The magnet switch 410 may be installed inside the container door, but may be installed at a position where it may be turned on by the magnet 420 when the handle hatch 20 is in the handle unlock position.

Meanwhile, according to an embodiment, the magnet 420 instead of the plate 40 may be installed in the lifting member 50, with the magnet switch 410 still being installed at a position where it can be turned on by the magnet 420 installed on the lifting member 50 when the handle hatch 20 is in the handle unlock position.

As shown in FIG. 8A, when the handle hatch 20 is in the handle lock position, the magnet switch 410 is kept in off state. In addition, as shown in FIG. 8B, when the handle hatch 20 is in the handle unlock position, the magnet 420 may approach the magnet switch 410, turning on the magnet switch 410.

According to an embodiment, contrary to the example shown in FIG. 8, it is also possible to provide the magnet 420 and the magnet switch 410 in a manner such that, when the handle hatch 20 is at the handle lock position, the magnet switch 410 is turned on, and when the handle hatch 20 is in the handle unlock position, the magnet switch 410 is turned off.

The second sensing unit 500 may be implemented as a wiring installed on the locking bar 51, which can break together when the locking bar 51 is broken. For example, when a thief attempting to intrude the container inserts an electric saw or the like into the gap between the container and the container door to break the locking bar 51, the wiring corresponding to the second sensing unit 500 also breaks.

The operation of the electronic seal system according to the present disclosure will now be described in more detail with reference to FIG. 9.

Figure 9:
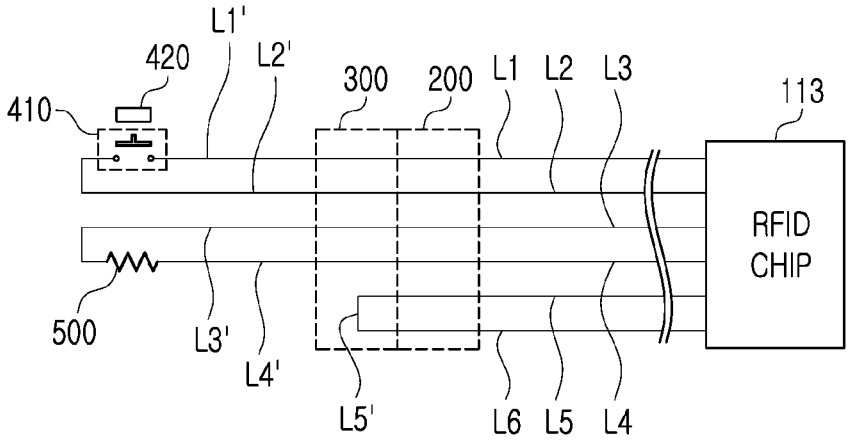
FIG. 9 is a view provided for explaining a circuit configuration in which a first connector and a second connector of an electronic seal system according to the present disclosure are electrically connected to each other.

FIG. 9 is a view provided for explaining a circuit configuration in which a first connector and a second connector of an electronic seal system according to the present disclosure are electrically connected to each other.

Referring to FIG. 9, the first connector 200 and the second connector 300 may be implemented as a male connector and a female connector having six pins and holes, respectively. Of course, the opposite is also applicable, in which case the first connector 200 and the second connector 300 may be implemented as a female connector and a male connector, respectively.

When the first connector 200 and the second connector 300 are connected to each other, a circuit may be configured of the RFID chip 113, the wirings L1, L2, L1', L2' and the magnet switch 410. When the handle hatch 20 is in the handle lock position, the magnet switch 410 is turned off and maintains a state in which no current flows. Then, when the handle hatch 20 changes to the handle unlock position, the magnet switch 410 is turned on by the magnet 420 so that current flows. Accordingly, the RFID chip 113 may sense that the magnetic switch 410 is turned on and thus sense that the handle hatch 20 is in the handle unlock position.

When the first connector 200 and the second connector 300 are connected to each other, a circuit may be configured of the RFID chip 113 and the wirings L3, L4, L3', L4', 500. Accordingly, when the wiring 500 break according to breakage of the locking bar 51, the circuit is open and no current flows. Accordingly, the RFID chip 113 may sense that the locking bar 51 is broken as there is no flow of current due to breakage of the wiring 500.

Meanwhile, when the first connector 200 and the second connector 300 are connected to each other, a circuit may be configured of the RFID chip 113 and the wirings L5, L6, L5'. Accordingly, when the first connector 200 and the second connector 300 are separated from each other, the circuit composed of the wirings L3, L4, L3' is open so that no current flows. Accordingly, the RFID chip 113 may sense whether the first connector 200 and the second connector 300 are connected or disconnected.

What is claimed is:

1. An electronic seal system for a container door for sensing abnormal opening/closing of the container door, wherein the container door comprises a retainer on which a locking rod installed outside the container door is seated and a handle hatch which binds or unbinds a handle seated on the retainer, wherein the electronic seal system comprises:

an electronic seal, which binds the retainer and the handle hatch, and which wirelessly transmits the abnormal opening/closing information of the container door to outside the container door;

a first connector electrically extending from the electronic seal;

a second connector, which is installed on the container door, and which is electrically connected to the first connector; and a first sensing unit electrically connected to the second connector to sense whether the handle hatch is opened or closed; and wherein the container door further comprises:

a rotation shaft passed through the container door and extended to an inner side and an outer side of the container door;

a plate coupled to the rotation shaft extended to the inner side;

a lifting member rotatably coupled to the plate; and a locking bar coupled to a lower side of the lifting member to lock or unlock the container door by being fixed to, or separated from a descending portion formed on a lower portion in a container, wherein the first sensing unit comprises:

a magnet installed on the plate or the lifting member; and a magnet switch configured to be turned on or off by the magnet installed on the plate to generate a signal corresponding to opening or closing of the handle hatch when the handle hatch is in the handle unlock position.

2. The electronic seal system of claim 1, further comprising a second sensing unit comprising a wiring installed on the locking bar that breaks together when the locking bar is broken.

3. The electronic seal system of claim 2, wherein the electronic seal comprises an antenna, and a RFID chip configured to sense, after electronic sealing is made, whether the handle hatch is opened or closed, whether the locking bar is broken or not, whether the electronic seal is released or not, and a connection state of the first connector and the second connector, and transmit, over the antenna, the sensed result according to an external request.

4. The electronic seal system of claim 3, wherein the electronic seal further comprises a light emitting unit configured to generate an alarm after electronic sealing is made, wherein the alarm corresponds to at least one of whether the handle hatch is opened or closed, whether the locking bar is broken or not, whether the electronic seal is released or not, and the connection state of the first connector and the second connector.

* * * * *